United States Patent [19]

Dravnieks

[11] 4,234,038

[45] Nov. 18, 1980

[54] TRANSFER WHEEL ASSEMBLY FOR AN AIR CONDITIONER AND METHOD OF MAKING THE WHEEL ASSEMBLY

[75] Inventor: Konstantins Dravnieks, Thiensville, Wis.

[73] Assignee: Wehr Corporation, Milwaukee, Wis.

[21] Appl. No.: 934,426

[22] Filed: Aug. 17, 1978

[51] Int. Cl.[3] ..... F28D 19/04

[52] U.S. Cl. ..... 165/10; 55/390; 29/157.3 R

[58] Field of Search ..... 165/8, 9, 10; 55/390; 29/157.3 R

[56] References Cited

U.S. PATENT DOCUMENTS

| | | | |
|---|---|---|---|
| 2,818,934 | 1/1958 | Pennington | 165/10 X |
| 3,092,477 | 6/1963 | Persson | 55/390 X |
| 3,596,709 | 8/1971 | Dauniebs | 165/10 X |
| 3,789,916 | 2/1974 | Lindahl | 165/8 |

*Primary Examiner*—Albert W. Davis

*Attorney, Agent, or Firm*—Michael, Best & Friedrich

[57] ABSTRACT

A transfer wheel assembly and a method for making the transfer wheel assembly is provided. The transfer wheel assembly is of the type for use in air conditioning systems for conditioning air flowing through an air conduit in response to the condition of air flowing through an adjacent air passage. The transfer wheel is conveniently constructed by having a central hub and a plurality of radially extending blades connected to the hub and extending radially outwardly. A plurality of condition transfer medium sectors are supported by the blades, the sectors each being pervious to axial flow of a gaseous medium and being capable of providing a condition transfer between itself and a gaseous medium flowing therethrough. The transfer wheel assemblies are conveniently assembled by cementing one radial edge of the sectors to a radial face of a supporting blade. The radially inner ends of the supporting blades are then joined to the central hub such that the sectors and supporting plates form a transfer wheel. The radially extending blades provide structural rigidity or reinforcement of the transfer medium sectors and also locate the sector radially and provide a convenient means for supporting the sectors in the transfer wheel assembly.

10 Claims, 4 Drawing Figures

TRANSFER WHEEL ASSEMBLY FOR AN AIR CONDITIONER AND METHOD OF MAKING THE WHEEL ASSEMBLY

BACKGROUND OF THE INVENTION

This invention relates to air conditioners and, more particularly, to transfer wheels as used in apparatus for conditioning air, and to a method for constructing transfer wheels.

Apparatus is well known wherein a wheel is arranged to rotate through two separate air passages, the wheels including transfer media capable of conditioning the air flowing in one passage on the basis of the condition of air flowing in the other passage. That is, the wheel can alter, for example, the temperature ture and humidity condition of the air flowing in one passage in accordance with the condition of the air flowing in the other passage.

Examples of transfer wheels of the type of the invention are shown in U.S. Pat. No. 3,596,709, issued Aug. 3, 1971, and U.S. Pat. No. 3,733,791, issued May 22, 1973, and assigned to the assignee of the present invention. Other examples of related prior art are shown in U.S. Pat. No. 3,416,595, issued Dec. 17, 1968; U.S. Pat. No. 3,379,240 issued Apr. 23, 1968; U.S. Pat. No. 3,605,874, issued Sept. 20, 1971; U.S. Pat. No. 2,432,198, issued Dec. 9, 1947; and U.S. Pat. No. 3,778,874, issued Dec. 18, 1973.

SUMMARY OF THE INVENTION

The present invention provides an improved transfer wheel which is more readily manufactured than prior art transfer wheels and an improved method for making transfer wheels.

The invention includes a transfer wheel assembly comprising, in combination, a shaft defining an axis of rotation, hub means operatively associated with the shaft for rotation about the axis, and a plurality of blades projecting radially relative to the axis, the blades each having radially extending planar faces and generally axially facing and oppositely directed side portions. The transfer wheel assembly further includes means for providing engagement between the hub means and the blades and a plurality of sectors of condition transfer medium supported by the blades and being pervious to flow of a gaseous medium and capable of providing a condition transfer between itself and the gaseous medium flowing therethrough. Each of the sectors is supported between two of the blades, and each of of the sectors includes opposed generally parallel axially facing surfaces and a pair of mutually diverging planar sides, the planar sides facing the blades and at least one of the sides being cemented to one of the blades.

The invention also includes a method for constructing a transfer wheel assembly including the steps of forming wedge shaped sectors of heat transfer medium, the sectors each having a pair of parallel planar faces, diverging planar sides joining the planar faces, and forming a plurality of generally elongated blades, the blades including opposed planar surfaces, and having a notch in the opposite longitudinal sides of each of the blades. The method further includes the steps of cementing the sectors to the elongated blades such that at least one of the planar sides of the sectors is bonded to one of the planar surfaces of the elongated blades, forming a hub with opposed, axially spaced projections, and assembling the blades on the hub with the projections engaged in the notches, with the blades projecting radially from the hub, and with each of the sectors between two of the blades.

One of the principal advantages of the invention is that the structure and method of construction of the transfer wheel assembly of the invention facilitate inexpensive manufacture of transfer wheels. For example, the construction of the transfer wheel permits the transfer wheel sections to be glued or cemented to the radially extending supporting blades, and any additional assembly steps otherwise required to secure the sectors in place can be avoided. Another of the advantages of the invention is that the radially extending blades provide structural rigidity or reinforcement for the transfer medium sectors and also locate the sectors radially and provide a convenient means for supporting the sectors in the transfer wheel assembly.

Other features and advantages of the invention will become known by reference to the following decription, to the appended claims and to the drawings.

Figure 1:
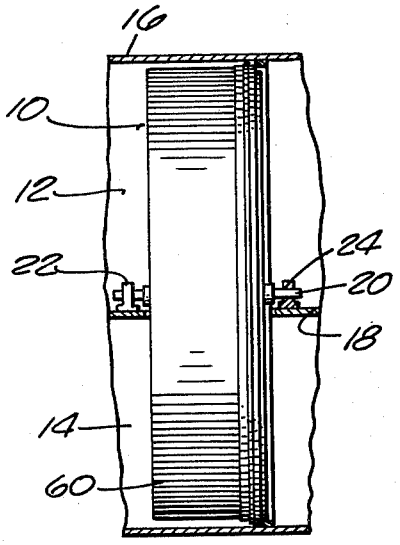
FIG. 1 is a generally sechmatic illustration of a portion of an air conditioning installation containing a transfer wheel assembly constructed in accordance with the invention.

Before describing at least one embodiment of the invention in detail it is to be understood that the invention is not limited to its application to the details of construction and the arrangement of the components set forth in the following description or illustrated in the drawings. The invention is capable of other embodiments and of being practiced and carried out in various ways. Also it is to be understood that the phraseology and terminology empolyed herein is for the purpose of description and should not be regarded as limiting.

DESCRIPTION OF PREFERRED EMBODIMENT

With particular reference to the drawings, transfer wheel assembly 10 is illustrated in FIG. 1 as mounted for rotation through two separate air flow passages 12 and 14. The air flow passages can be defined by a circular outer housing section 16 and a common diametrically disposed wall 18. In this manner housing 16 functions as a shroud around the transfer wheel assembly insuring passage of air flow through the wheel. This flow of air through the wheel will be described more completely hereinafter. It should be appreciated, however, that the actual configuration of the passages and housing is not critical so long as the air flow in the passages is channeled through the wheel assembly. For example, the housing section may be rectangular in cross section with an interior panel bearing a circular opening in which the wheel rotates. The function of the transfer wheel assembly is to alter the condition (temperature or humidity) of the air flowing in one passage, 12 or 14 in accordance with the condition (temperature or humidity) of the air flowing in the other passage. Structurally, the transfer wheel assembly includes a shaft 20 mounted in bearings 22 and 24, supported, for example, on common housing wall 18 so that the transfer wheel assembly is rotatable through both air passages 12 and 14.

Figure 2:
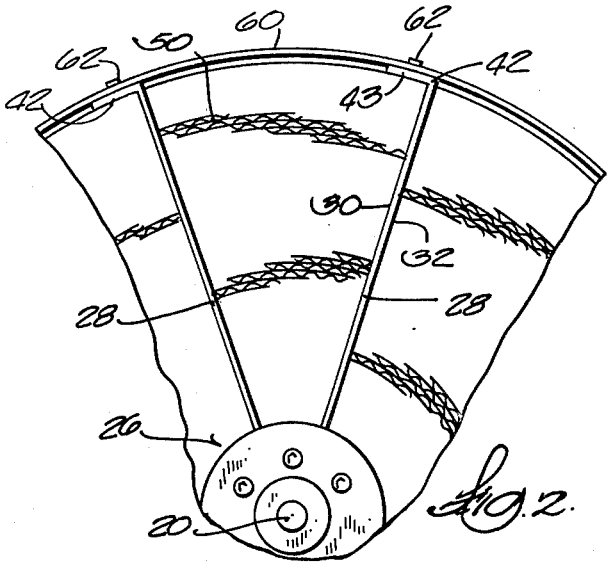
FIG. 2 is an end elevation view of a portion of the structure of FIG. 1.
Figure 3:
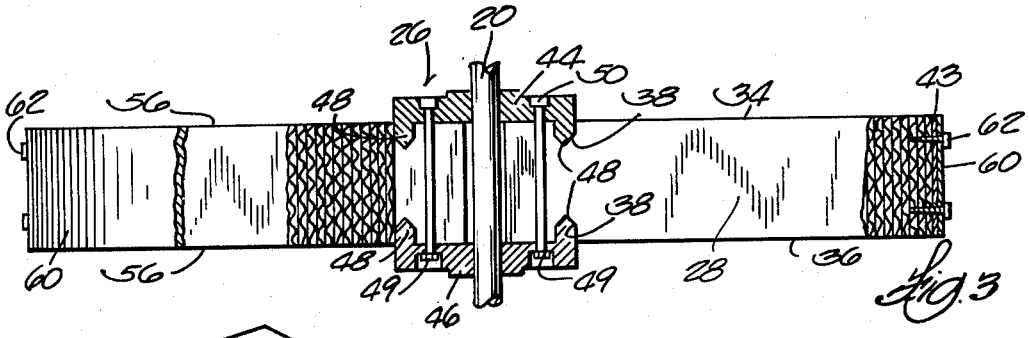
FIG. 3 is an axial section of the transfer wheel assembly shown in FIG. 1.
Figure 4:
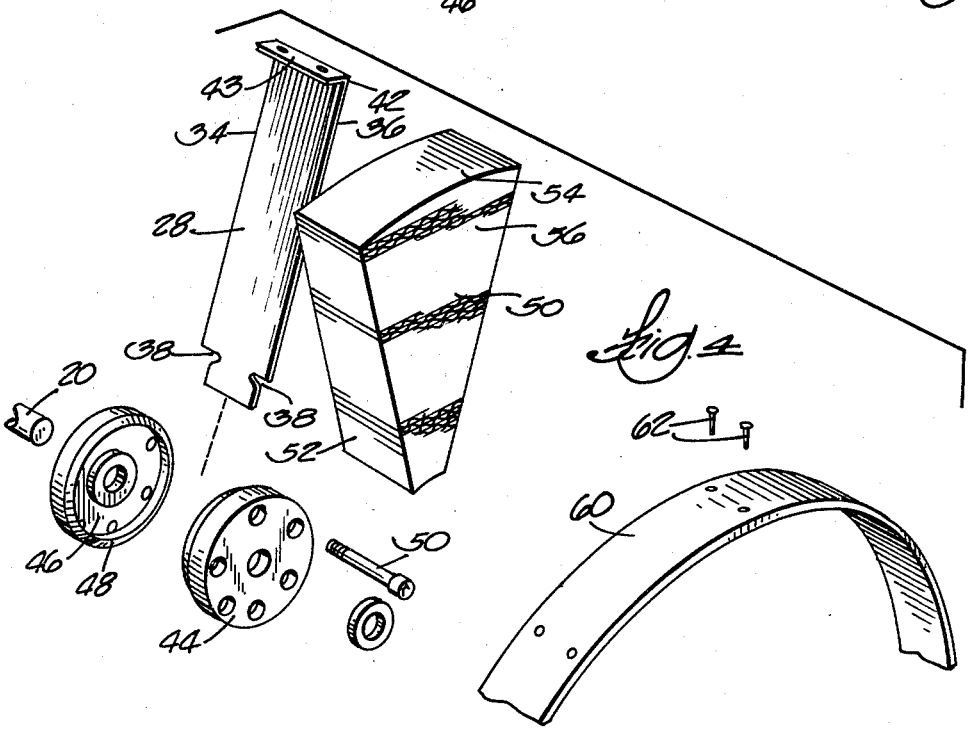
FIG. 4 is an exploded perspective view of a portion of the transfer wheel assembly of FIG. 1.

The structure of the transfer wheel assembly is best illustrated in FIGS. 2 through 4. The wheel assembly includes a central hub 26, which carries shaft 20, and a number of generally planar blades 28 projecting radially from the hub 26 with respect to the shaft 20. The blades 28 are all of the same configuration and only one blade 28 will be described in detail. The blades 28 are elongated and generally planar having opposite major faces 30 and 32 which have both a radial and axial extension. The longitudinal sides 34 and 36 of the blades are each provided with a notch 38. All of the blades 28 are also provided with a lip 43 at their radially out ends, the lip 43 extending transversely to the plane of the blades. The notches 38 are used during manufacturing as the gauging points for accurately establishing the bend line of the lip 43 and thereby function to accurately establish the length of the blades 28.

Hub 26 includes two generally indentically formed hub sections 44 and 46. Since the hub sections are identical, only one section will be described in detail. With particular reference to FIGS. 3 and 4, hub section 44 is generally circular and includes a generally annular projection 48. The annular projection 48 is accurately located with respect to the center or axis of the hub 26 so that, when the hub 26 is assembled on the shaft 20, the annular projection 48 will also be accurately concentrically located with respect to the shaft 20 and the axis of rotation of the transfer wheel assembly. The two hub sections 44 and 46 are interconnected by bolt assemblies 49. In their assembled relationship, the hub sections, and consequently the annular projections 48 thereof, are spaced axially with respect to each other. Projections 48 extend toward each other and have configurations complementary to that of the notches 38 into which they fit. In this connection, other complementary configurations can be used.

With the hub sections 44 and 46 assembled as illustrated in FIG. 3, the blades 28 are positively held in position with respect to the shaft 20, and consequently the axis of rotation of the transfer wheel assembly, by the notch and projection connection formed by annular projections 48 and notches 38. The interengagement achieved by this notch and projection connection establishes a maximum, fixed radial extension of the blades from the hub or axis of rotation and also holds the blades in a desired radial orientation perpendicular to the axis of rotation of the transfer wheel assembly. The blade edges engaged by hub sections 44 and 46 are preferably relieved in all areas except at projections 48 so that engagement occurs only in the area of the projections to insure positive engagement and accurate blade location.

As can be seen in FIG. 2, the blades 28 are radially spaced apart with each extending in a precise radial plane. A generally pie shaped sector 50 of condition transferring media is positioned between each pair of spaced apart blades 28. The condition transferring media permits air flow in the axial direction through the transferring temperature or humidity conditions from one of the flowing air streams to the other and in one preferred embodiment comprises an open cellular asbestos material coated or impregnated with a hygroscropic material such as lithium chloride.

The transfer medium sectors 50 each include a pair of diverging radially extending planar sides 52 joined at their radially outer ends by an arcuate surface 54. The sectors 50 also include opposed parallel axially facing planar faces 56. The sectors 50 are each positioned between a pair of radially extending supporting blades 28 and are held in place between the respective pairs of adjacent supporting blades 28 by cement or other bonding materials joining at least one of the radially extending planar sides 52 to an opposed planar face 30 or 32 of an adjacent blade 28. The sectors 50 are further secured in place by the lip 43 of the blade 28 which is located against a portion of the radially outer arcuate surface 54 of the sector.

To complete the structure of the transfer wheel, an outer generally cylindrical ring 60 extends around the transfer wheel assembly. Ring 60 is suitably attached to the blades for example by rivets 62 to the outer radial ends 42 of the blades.

The transfer wheel may be conveniently constructed in accordance with the invention by first cementing one of the radially extending sides 52 of each of the transfer medium sectors 50 to one of the planar sides 30 or 32 of the radially extending supporting blades 28. The planar blades 28 and sectors 50 may then be assembled in circular relation and the hub sections 44 and 46 clamped against the opposite sides of the blades 28 by bolts 49 with the projections 48 housed in notchs 38 to thereby prevent radial outward movement of the sectors 50. The cylindrical ring 60 can then be placed around the sectors 50 and joined to the lips 43 of the blades 28 by rivets 62.

The structure and method of construction of the transfer wheel of the invention provide a transfer wheel assembly which is particularly rigid and durable yet is also conveniently and inexpensively manufactured. The radially extending supporting blades are conveniently joined to the transfer medium sectors by cement and provide substantial structural support for the sectors, thereby permitting the transfer wheel assemblies to be constructed without a substantial number of other supporting members. The radially extending blades also locate the sectors radially such the transfer wheels are well balanced. The supporting blades bonded to the sectors also provide a convenient means for attaching the sectors to the transfer wheel hub.

Various of the features of the invention are set forth in the following claims.

I claim:

1. A transfer wheel assembly comprising, in combination, a shaft defining an axis of rotation, hub means operatively, associated with said shaft for rotation about said axis, a plurality of blades projection radially relative to said axis and being planar in an axial direction and including opposite radially extending planar faces and generally axially facing and oppositely directed side portions, means for providing engagement between said hub means and said blades, and a plurality of sectors of condition transfer medium supported by said blade and being pervious to flow of a gaseous medium and capable of providing a condition transfer between itself and the gaseous medium flowing therethrough, each of said sectors being supported between two of said blades, and each of said sectors having opposed generally parallel axially facing faces and a pair of mutually diverging planar sides joining said faces, said planar sides facing said blades and at least one of said sides being cemented to one of said blades, and said blades including means for engaging said sectors and for locating said sectors with respect to said blades.

2. The transfer wheel assembly set forth in claim 1 wherein said sectors are comprised of cellular material coated with lithium chloride.

3. The transfer wheel assembly set forth in claim 1 wherein said means for providing engagement between said hub means and said blades include means defining a projection and notch connection between said hub means and said blades at said blade side portions to hold said blades in a preselected orientation relative to said axis.

4. The transfer wheel assembly set forth in claim 1 and further including a generally cylindrical member engaging and connected to said blades at the radially outer ends of said blades for rotation therewith, said cylindrical member extending around and closing the periphery of said wheel assembly as defined by said radially outer blade ends.

5. A method for constructing a transfer wheel assembly comprising the steps of:

forming wedge shaped sectors of heat transfer medium, said sectors each having a pair of parallel planar faces and diverging planar sides transverse to the planar faces and joining the planar faces;

forming a plurality of generally elongated blades, said blades including opposed planar surfaces and opposite axially spaced parallel longitudinal sides;

forming a notch in the opposite longitudinal sides of each of said blades;

bonding said wedge shaped sectors to said elongated blades such that each of said sectors includes one planar side bonded to planar surfaces of respective ones of said elongated blades;

forming a hub to be rotatable about a longitudinal axis and with opposed, axially spaced annular projections; and assembling said blades having said wedge shaped sectors bonded thereto on said hub with said projections engaged in said notches, with said blades projecting radially from said hub, and with each of said sectors being located between two of the blades and being bonded thereto by cement.

6. A transfer wheel assembly comprising, in combination, a shaft defining an axis of rotation, hub means operatively associated with said shaft for rotation about said axis, a plurality of blades projecting radially relative to said axis and being planar in an axial direction, and including opposite radially extending planar faces and generally axially facing and oppositely directed side portions, means for providing engagement between said hub means and said blades, and a plurality of sectors of condition transfer medium supported to said blades and being pervious to flow of a gaseous medium and capable of providing a condition transfer between itself and the gaseous medium flowing therethrough, each of said sectors being supported between two of said blades, and each of said sectors having opposed generally parallel axially facing faces and a pair of mutually diverging planar sides joining said faces, said planar sides facing said blades and at least one of said sides being cemented to one of said blades, said one of said blades including a radially outer end and a lip integrally attached to said radially outer end and transverse to said planar faces, said lip engaging a radially outer end of one of said sectors to restrain said one of said sectors against radial movement.

7. The transfer wheel assembly set forth in claim 6 wherein said sectors are comprised of cellular material coated with lithium chloride.

8. The transfer wheel assembly set forth in claim 6 wherein said means for providing engagement between said hub means and said blades includes means defining a projection and notch connection between said hub means and said blades at said blade side portions to hold said blades in a preselected orientation relative to said axis.

9. The transfer wheel assembly set forth in claim 6 and further including a generally cylindrical member engaging and connected to said blades at the radially outer ends of said blades for rotation therewith, said cylindrical members extending around and closing the periphery of said wheel assembly as defined by said radially outer blade ends.

10. A method for constructing a transfer wheel assembly comprising the steps of:

forming wedge shaped sectors of heat transfer medium, said sectors each having a pair of parallel planar faces and diverging planar sides transverse to the planar faces and joining the planar faces;

forming a plurality of generally elongated blades, said blades including opposed planar surfaces and opposite axially spaced parallel longitudinal sides;

forming notches in the opposite longitudinal sides of each of said blades;

forming a lip on each of said blades transverse to said planar surfaces and for engaging the radial outer ends of said sectors when said sectors are cemented to said blades;

forming a hub with opposed, axially spaced annular projections; and assembling said blades on said hub with said projections engaged in said notches, with said blades projecting radially from said hub, and with each of said sectors being located between two of the blades and being bonded thereto by cement.

* * * * *